US005736304A

United States Patent [19]

Rider et al.

[11] Patent Number: 5,736,304

[45] Date of Patent: Apr. 7, 1998

[54] METHOD OF PROCESSING BLACK-AND-WHITE PHOTOGRAPHIC MATERIALS

[75] Inventors: Christopher Barrie Rider, New Malden, England; Mark Joseph Devaney, Jr., Rochester, N.Y.; Paul W. Wagner, Holley, N.Y.; Andrew Michael Wyner, Rochester, N.Y.

[73] Assignee: Eastman Kodak Company, Rochester, N.Y.

[21] Appl. No.: 642,747

[22] Filed: May 3, 1996

[51] Int. Cl.[6] ..... G03C 5/395

[52] U.S. Cl. ..... 430/398; 430/400; 430/455; 430/463; 430/963

[58] Field of Search ..... 430/398, 400, 430/455, 372, 963, 463

[56] References Cited

U.S. PATENT DOCUMENTS

| | | | |
|---|---|---|---|
| 4,839,273 | 6/1989 | Yamaka et al. | 430/634 |
| 4,855,218 | 8/1989 | Fujita et al. | 430/428 |
| 4,960,683 | 10/1990 | Okazaki et al. . | |
| 5,009,983 | 4/1991 | Abe | 430/372 |
| 5,019,850 | 5/1991 | Ishikawa et al. | 354/322 |
| 5,378,588 | 1/1995 | Tsuchiya | 430/428 |
| 5,474,878 | 12/1995 | Sakuma | 430/400 |
| 5,508,153 | 4/1996 | Ishikawa et al. | 430/963 |

OTHER PUBLICATIONS

Patent Abstracts of Japan, vol. 6, No. 262 (P-164) (1140), 21 Dec. 1982 & JP-A-57 157243 (Konishiroku Shashin Kogyo KK), 28 Sep. 1982 (Abstract).

Database WPI, Section Ch, Week 8602, Derwent Publications Ltd., London, GB; Class G06, AN 86-010682, XP002012300 & JP-A-60 235 133 (Konishiroku Photo Ind. Co. Ltd.), 21 Nov. 1985 (Abstract).

*Primary Examiner*—Hoa Van Le

*Attorney, Agent, or Firm*—Frank Pincelli

[57] ABSTRACT

A method of processing silver halide black-and-white photographic material in a processing machine which transports the material to be processed, through several processing tanks. The processing machine includes at least one tank with fixing ability and at least one tank which is either a wash or stabilizer tank. The wash or stabilizer tank furthest from the fixer tank(s) is replenished with wash or stabilizer solution. Outflow from the wash tank or stabilizer tank nearest the fixer tank(s) is passed to the nearest fixer tank together with a fixer replenishment solution to maintain the fixer's working composition. The total submersion time in the tank(s) having fixing ability is less than 25 seconds and the ratio of coated silver in the unprocessed photographic material (in g/m$^2$) to the sum of the rates of addition to the fixer tank (in l/m$^2$) of the wash outflow and fixer replenishment solution is greater than 10 g/l.

10 Claims, 3 Drawing Sheets

METHOD OF PROCESSING BLACK-AND-WHITE PHOTOGRAPHIC MATERIALS

FIELD OF THE INVENTION

This invention relates to the processing of photographic materials and particularly to the fixing and washing of said materials.

BACKGROUND OF THE INVENTION

In recent years, there has been an increasing trend to reduce the amount of water used in photographic processing for environmental reasons. Water is recognised as a valuable natural resource and efforts have been made to reduce the amount of water used in washing photographic materials to a minimum. An additional incentive is that in some countries, users of photographic processing apparatus are now charged according to the amount of water used. It can therefore pay the user to reduce water consumption.

Another recent trend in photographic processing is the emergence of "plumbless" processors where replenisher solution containers and effluent containers are housed within the processor. Thus no external plumbing, e.g. to a water supply or drain, is required for these machines. Instead, replenisher solutions and effluent are brought to and from the machine in suitable containers. To minimise the frequency of exchanging the replenisher and effluent containers it is desirable that the replenishment rates be as low as possible.

Washing photographic materials is necessary to remove any processing chemicals from the processed material which might, in time, degrade the image. This degradation may happen though destruction of the image—i.e. a lowering of density—or it may happen through an increase in density as coloured substances are formed within the film or paper. Temperature, humidity and light all have a strong effect in accelerating these processes. To preserve an image adequately, the level of residual chemicals in the processed film must be kept low. In particular, the fixing agent and by-products of the fixing reaction are known to cause image degradation if they are retained in significant amounts in the film.

Stabilizer solutions may also be used instead of water for the wash section of a processor. Stabilizers usually contain additives such as a wetting agent to enhance washing and drying, a biocide to guard against biogrowth in the solution or on tank and roller surfaces, hardening agents and possibly other additives to retard the effects of ageing in the processed photographic material.

In the graphic arts industry, very high contrast black-and-white materials are used. Images are formed with areas of developed silver (black) and no silver (clear for film and white for paper) only. Traditionally, the major requirement for the washing section of a processor has been to maintain low levels of retained fixing agent (e.g. ammonium thiosulphate) in the processed film. This has been achieved by using very high wash replenishment rates and it has not been uncommon to find graphic arts processors using between 2 and 10 liters of water per square meter of film processed. Retained non-image silver has not usually found to be a major cause of image deterioration since fixer replenishment rates have also been high. Often, graphic arts processors have been equipped with silver recovery systems which remove silver from the fixing solution and so maintain low silver levels, typically around 2 grams per liter. With such low silver levels in the fixing bath and with large dilutions of silver carried into the wash section made possible by the high wash replenishment rates, the control of retained non-image image silver has not been a problem. However, with the recent trend to use less wash water, and with the use of lower fixer and wash solution replenishment rates the levels of silver in the wash baths will rise. This situation is also of concern in the processing of radiographic and other types of black-and-white silver halide photographic materials.

Soluble complexes of silver with fixing agent are by-products from the fixing reaction. These complexes are produced in the photographic material as the fixing agent reacts with undeveloped silver in the form of silver halide. The complexes diffuse out of the material and into the bulk of the fixing solution. Without silver recovery on the fixing bath, the concentration of complexed silver may build up to quite high levels, especially when low replenishment rates are used for the fixer (i.e. there is no substantial dilution of fixing by-products due to the addition of replenisher) and when the level of silver in the photosensitive material is high. Since fixing rate shows an inverse dependence on silver concentration in the fixer bath, the time required to clear the film will also depend on the silver level. Whilst silver recovery is therefore beneficial for the performance of the fixer bath, it represents significant extra capital cost. We have now found that it is not absolutely necessary provided precautions are taken to ensure adequate time is allowed for fixing and washing and to ensure that the wash section is able to cope with the demands of removing both the fixing agent (typically ammonium or sodium thiosulphate) as well as the larger soluble silver complexes from the film.

A particular problem for graphic arts films is a rise in the optical density in the ultra-violet region of the spectrum of the non-image areas, referred to as "UV $D_{min}$", upon ageing of processed film. Frequently, ultra-violet contact exposures are used to copy a graphic arts film onto a printing plate or another piece of film and very high contrast images are needed for accurate copying. If, due to ageing, the difference between the minimum and maximum optical density of the image to be copied is reduced, the contrast of the image is effectively lowered. When the image is copied, inaccuracies may result. Furthermore, if the minimum density of the image increases, the overall exposure time for the copying process increases. For other types of black-and-white silver halide images, changes in the tone scale and contrast of the image upon ageing are also detrimental even if no further copying process is involved because the quality of the image is reduced.

It has been determined experimentally that the action of non-image retained silver is very significantly worse for image degradation, and in particular for UV $D_{min}$ increase, than that of an equal weight of retained fixing agent. Given sufficient time, colourless silver compounds produced as by-products of the fixing reaction are converted into coloured compounds such as silver sulphide. Normally, silver complexes are present in the fixer and wash solutions at significantly lower concentration than the fixing agent. In certain circumstances, however, especially in processors without silver recovery, the control of residual silver in the processed film may become more important than the control of residual fixing agent in determining wash water requirements.

Fixing is a two-part process: first undeveloped silver is converted to a soluble silver salt within the film (i.e. clearing) and then the soluble salt is washed out. In recent years, with the drive to reduce processing times, in some cases, fixing times have been reduced so that the "washing out" part of the fixing process has significantly less time allocated than the "solubilization" part of the process. If a fixed film does not have sufficient time to equilibrate with the fixer bath, with the result that the washing out of the soluble silver salts is substantially incomplete, it will carry over into the wash section a greater quantity of silver than expected, thus making more demands on the wash section. It is therefore preferable both to maintain a low level of silver in the fixer, and also to allow enough time so that the "washing-out" part of the fixing process is virtually complete.

Common practice in the graphic arts industry has been to replenish the wash section in a processor with fresh water from the main water supply and to pass the overflow from the wash section directly to drain or to collect it for subsequent treatment before discharge to drain. Similarly, common practice for the replenishment of fixer baths has been to mix fixer concentrate with water directly from the public water supply in a predetermined ratio externally to the processor to form a working strength fixer replenisher solution. The replenisher solution is then either added directly to the processor's fixer replenisher tank, or to a central holding vessel for replenisher from where it may be piped to several processors' fixer replenishment systems.

U.S. Pat. No. 5,019,850 (Ishikawa et al) describes a photographic processor for colour paper in which the bleach/fixing bath is replenished with a mixture of concentrated processing liquid and liquid extracted from the wash section. One example describes a processor in which the bleach-fix bath is replaced by a separate bleach and fix followed by 3 wash baths where some of the wash solution in the first wash bath is pumped into the fixer bath together with some fixer concentrate. There is no reference to black-and-white materials.

U.S. Pat. No. 5,378,588 (Tsuchiya) is similar to the above but it employs solid replenishers rather than solutions.

U.S. Pat. No. 5,009,983 (Abe) describes a photoprocessor for colour materials where the apparatus claimed includes a reverse osmosis system for treating water from one of the wash tanks and reusing it.

It is noted that for a graphic arts film or for a radiographic film, coated silver weights of around 3 grams per square meter or more are typical whereas for a colour paper, the coated silver weight will typically be less than 1 gram per square meter. The demands placed upon the fix and wash baths are therefore very different.

PROBLEM TO BE SOLVED BY THE INVENTION

The problem to be solved by the present invention is how to efficiently fix and wash black and white silver halide photographic materials, for example graphic arts (very high contrast) or radiographic materials, using the minimum amount of water for washing while retaining adequate image stability, the materials having been processed in a processor in which the fixer tank contains high levels of silver, for example, one which is not equipped with any means of silver recovery.

SUMMARY OF THE INVENTION

According to the present invention there is provided a method of processing silver halide black-and-white photographic material in a processing machine which transports the material to be processed, through several processing tanks including, at least one tank with fixing ability and at least one tank which is either a wash or stabilizer tank characterised in that:

i) the wash or stabilizer tank furthest from the fixer tank(s) is replenished with wash or stabilizer solution, ii) outflow from the wash tank or stabilizer tank nearest the fixer tank(s) is passed to the nearest fixer tank together with a fixer replenishment solution to maintain the fixer's working composition, iii) the total submersion time in the tank(s) having fixing ability is less than 25 seconds and iv) the ratio of coated silver in the unprocessed photographic material (in $g/m^2$) to the sum of the rates of addition to the fixer tank (in $l/m^2$) of the wash outflow and fixer replenishment solution is greater than 10 g/l.

ADVANTAGEOUS EFFECT OF THE INVENTION

Surprisingly, despite the fact that the wash outflow contains silver which acts to retard fixing rate, in the present invention it is possible to achieve an improvement both in fixing and washing performance at the same time. Fixing performance is improved by reducing the time needed to fix the photographic material to the required extent.

Furthermore, concentrated fixer solution may be used as replenisher to be diluted by the addition of wash water so that the volume of fixer solution used is reduced compared with the case when working strength replenisher is used.

Washing performance is improved either by enabling a reduction in wash water used or by enabling a reduction in washing time or both.

The possibility for these multiple improvements arises from a lowering of the silver concentration in the fixer bath. This is achieved because the volume of solution added to the fixer tank per unit area of material processed is typically greater than that used in the prior art. Since the volume of solution added to the fixer bath for replenishment is increased, the concentration of silver in the fixer solution is decreased due to simple dilution considerations. The effect of this on the fixer is to increase fixing rate.

A further effect of lowering of the silver level in the fixer is that the carry-out of silver from the fixer solution by the photographic material being processed is lowered. This results in lower concentrations of silver in the wash bath(s) with the consequence that the level of residual silver in the processed film also reduces. This advantage may be traded for a reduction in wash replenishment rates or washing time.

Further benefits of increasing the flow through the fixer bath arise from the increased dilution of developer carry-in products. Some components of the developer can lead to unwanted stain if they are not properly washed out. It is also known that components of the developer, such as potassium ion, may inhibit fixing rate. The increased dilution of these components can actually improve fixing rates with the present invention.

The advantages of the invention compared with common industry practice can be summarised thus:

i) The time taken to adequately fix the photographic material may be reduced.

ii) The capital cost of a fixer silver recovery unit is avoided. Silver recovery can, however, still be carried out on the discarded used solutions.

iii) The volume of solution needed to replenish both fixer and wash baths may be reduced.

iv) The time taken to adequately wash the photographic material may be reduced.

v) The dilution of developer solution in the fixer tank may be increased avoiding stain problems.

BRIEF DESCRIPTION OF THE DRAWINGS

In the accompanying drawings.

DETAILED DESCRIPTION OF THE INVENTION

Figure 1:
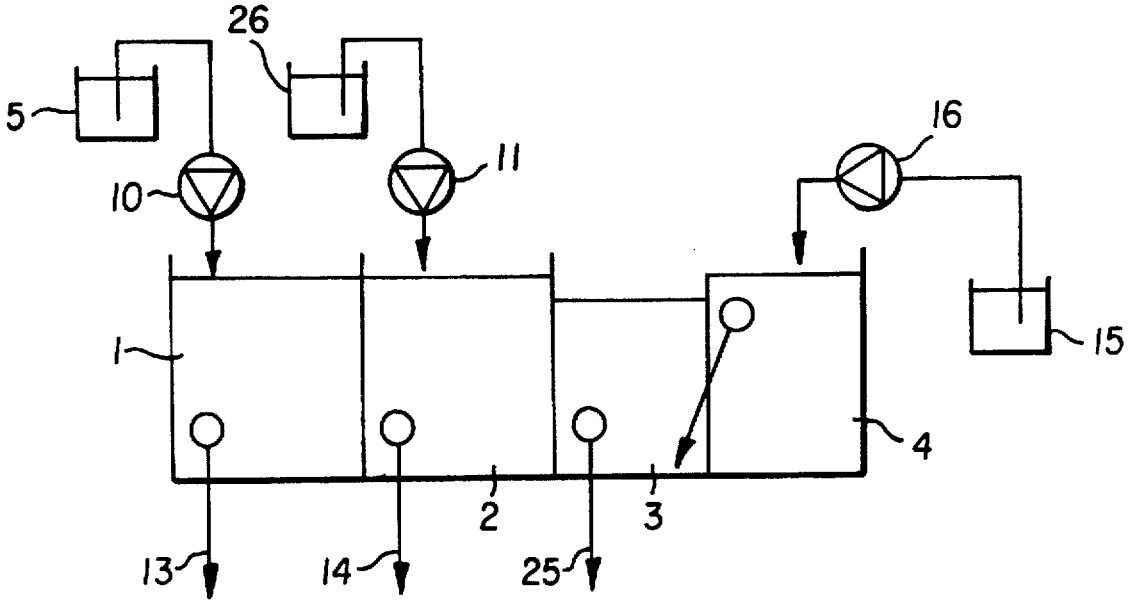
FIGS. 1, 2, 3 and 4 show embodiments of the present invention

The preferred method of operation is to use the entire outflow of the wash/stabilizer tank nearest the fixer tank to dilute concentrated fixer replenisher solution added to said fixer tank.

As wash replenishment rates are lowered, the level of contaminants in the wash overflow increases. For very low wash replenishment rates, where there is a high level of contaminants in the wash overflow, the chemical composition of the made up fixer replenisher solution will be significantly changed from aim. For example, when comparing the compositions of two batches of working strength fixer replenisher made to the same method, one with fresh water and the other with highly contaminated wash effluent, we find that the ionic strength of working strength fixer made with highly contaminated wash overflow will be higher; the concentration of fixing agent and sulphite will be higher; the concentration of silver will increase and the pH will differ. The pH change may adversely affect the ability of the fixer to stop development continuing as the material passes from the developer bath into the fixer bath. This can result in the production of dichroic fog, the physical development of very fine particles of silver in the material, causing an increase in the ultra-violet density of the material. This is a significant disadvantage in the processing of graphic arts materials, since they are frequently used as a mask for ultra-violet contact exposures. The increase in fixing agent concentration may reduce fixing rate slightly if the concentration is different from aim. The increase in silver level will reduce fixing rate. The increase in ionic strength will affect photographic material gelatin swell which may also reduce fixing rate. When rapid fixing is desired, these retarding effects can cause a significant loss of fixing performance, which results in increased load on the wash section of the processor and increases the level of residual chemicals in the processed photographic material. To counteract these detrimental effects, it is necessary to reformulate the fixer concentrate when using the present invention at very low fix and wash replenishment rates.

Preferably the concentration of silver in at least one of the baths with fixing ability is greater than 10 g/l, more preferably greater than 15 g/l.

Preferably the fixer replenishment rate is below 125 ml/m$^2$, particularly below 75 ml/m$^2$ and especially below 65 ml/m$^2$ of material processed. The wash or stabilizer replenishment rate is preferably below 250 ml/m$^2$, especially below 150 ml/m$^2$ and particularly below 125 ml/m$^2$ of material processed. In the present process fixing times should be short. Fixing time is normally set for a given material type and processor by determining the time required to adequately fix the material under the worst conditions for fixing, i.e. when there is a high concentration of silver and other seasoning products in the fixer. This situation will arise when the film has received a low average exposure level.

A common rule-of-thumb has been used for many years in black-and-white processing: namely that fixing time should be twice the clearing time, i.e. double the time at which all the silver has been solubilized. A preferred fixing time can be defined as one where 80% of the silver is removed from a non-image area of the material being processed in 80% of the fixer submersion time when the fixer bath has been seasoned with substantially unexposed film. This definition removes all the safety margins associated with the old rule-of-thumb and can therefore be considered as defining an acceptable "short" fixing time.

A simple formula may be used to provide a good estimate of the concentration of a fixer bath which has been seasoned with unexposed film in the case where the processor is operated in the manner of the present invention, i.e. where all the outflow of the wash section is passed into the fixer bath. For the purposes of the analysis, we may treat the fixer and any number of washing baths as a single system and look at the volumes of solution passing into and out of the system (a volume balance). We also need to perform a mass balance on the system by looking at the mass of silver per unit area of film processed which enters and leaves the system.

If F is the volume of fixer replenisher added to the fixing bath per unit area of film processed, W is the volume of wash solution taken out of the first wash bath and added to the fixer bath per unit area of film processed, A is the coated weight of silver in the film per unit area (which is all assumed to be solubilized in the fixing bath), δ is the difference in volume between the carryout per unit area of film from the last wash bath and the last fixer bath (taking account of small gelatin swell changes), a is the residual silver remaining in the film after leaving the last wash bath and $C_{fmax}$ is the maximum silver concentration in the first fixer bath (i.e. the fixer effluent concentration), we may write, $$C_{fmax}=(A-a)/(W+F+\delta)$$

Since a is typically less than 50 mg/m$^2$ by design and A is typically greater than 2.5 g/m$^2$ for most black-and-white photographic film products, we may neglect a. The value of δ is typically around 5 ml/m$^2$ for a photographic material with gelatin on both sides, whereas W+F is almost certainly greater than 100 ml/m$^2$ and is probably greater than 150 ml/m$^2$. We may therefore neglect δ to give a good estimate of the maximum fixer silver concentration which is probably accurate to within 5% and almost certainly accurate to within 10%. The above formula may now be written in a very useful simplified form:

$$C_{fmax}=A/(W+F)$$

In the accompanying drawings FIG. 1 shows a conventional processor which includes a developer tank (1), a fixer tank (2) and two wash tanks (3 & 4). The developer tank (1) is replenished from a holding tank (5) of previously mixed working strength developer replenisher, which is pumped into the developer tank at an appropriate rate by means of pump (10). The fixer tank (2) is replenished by means of pump (11), passing fixer concentrate from the holding vessel (26) into the fixer tank (2) at an appropriate rate. Wash tanks (3) and (4) are arranged such that when fresh wash solution is pumped from holding tank (15) by pump (16) into wash tank (4), the overflow so produced passes into wash tank (3), forming a conventional counter-flow wash section. Overflow (25) from the wash tank(s) passes out of the processor as effluent as does fixer overflow (14) and developer overflow (13).

Figure 2:
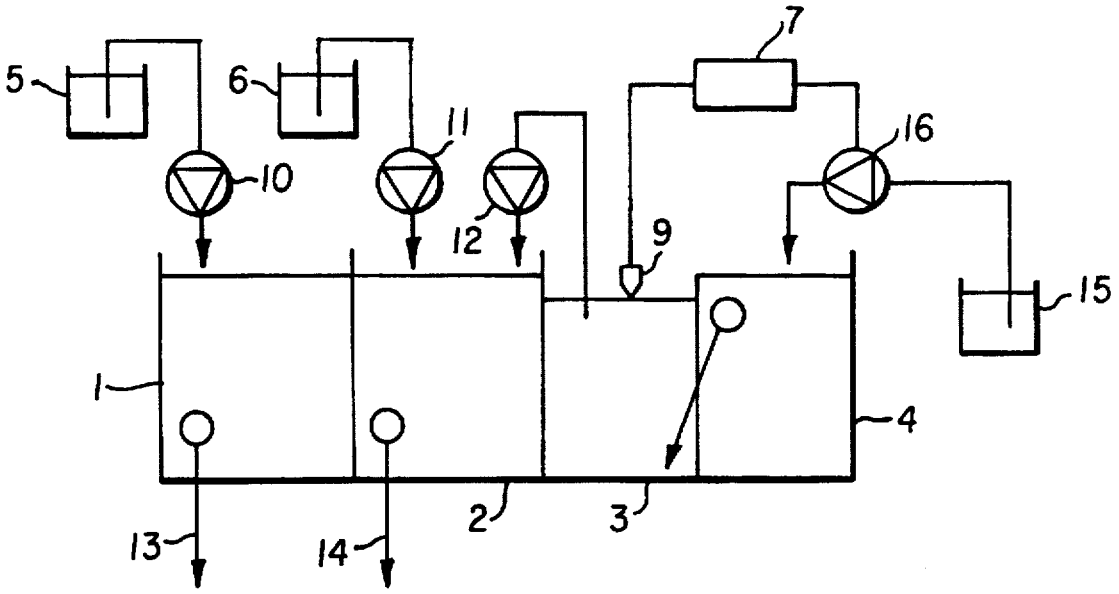

FIG. 2 shows one embodiment of the present invention. The processor includes a developer tank (1), a fixer tank (2) and two wash tanks (3 & 4). The developer tank (1) is replenished from a holding tank (5) of previously mixed working strength developer replenisher, which is pumped into the developer tank at an appropriate rate by means of pump (10). The fixer tank (2) is replenished by means of pump (11), passing working strength fixer replenisher from the holding vessel (6) and pump (12) passing wash water from wash tank (3) into the fixer tank (2) at an appropriate rate. The rates of replenishment of the solutions supplied by pumps (11) and (12) are maintained in a predetermined ratio. Wash tanks (3) and (4) are arranged such that when fresh wash solution is pumped from holding tank (15) by pump (16) into wash tank (4), the overflow so produced passes into wash tank (3), forming a conventional counter-flow wash section. Level sensor, (9) detects when the level of wash solution in wash tank (3) drops below a certain predetermined level. When the level drops below this predetermined level, a signal produced by the level sensor control means (7) sends a signal to pump (16) to add fresh wash solution to wash tank (4). When the level in wash tank (3) has increased above a certain predetermined level due to the overflow from wash tank (4), the level sensor control means ends the flow of fresh wash solution into wash tank (4). Extra level sensors (not shown) may also be provided so that evaporation losses may be controlled and appropriate extra solution replenishment may be made in any of the tanks.

Figure 3:
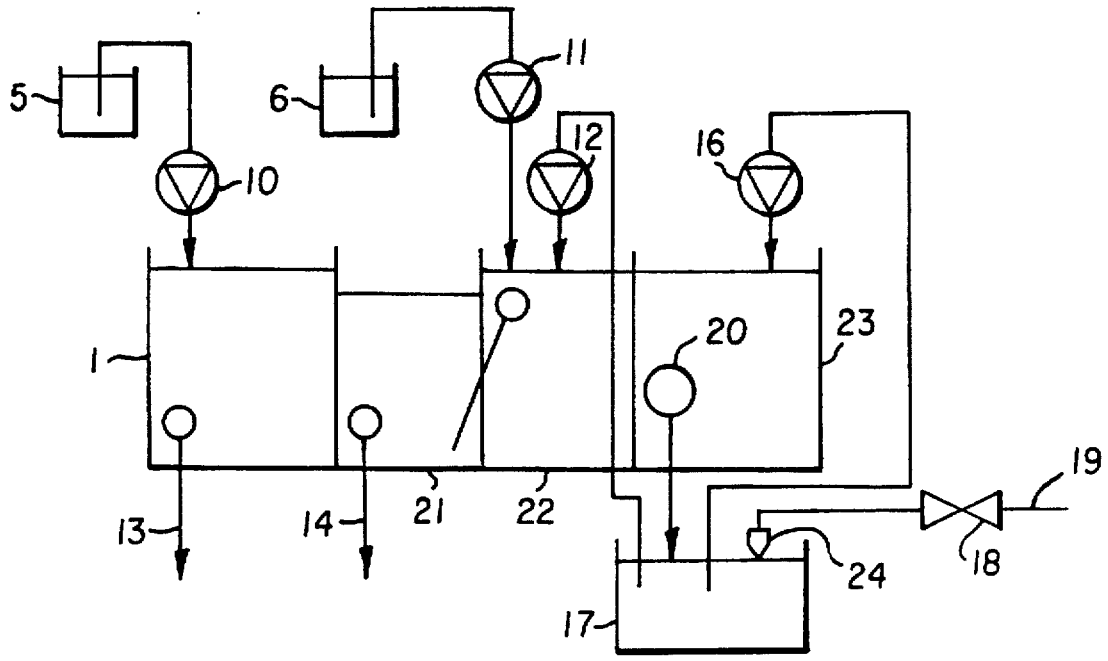

FIG. 3 shows a processor similar to that described in FIG. 2 except that it is provided with two fixer tanks (21 & 22) and only one wash tank (23). The fixer tanks are arranged so that replenisher solutions are pumped into fixer tank (22) and the overflow thereby produced passes into fixer tank (21). The wash tank (23) is provided with a sump (17) from which wash solution is recirculated by pump (16) which continually pumps solution from the sump (17) into the wash tank (23). The overflow from the wash tank (23) passes down a pipe (20) back into the sump. A float valve (24) senses the level in the sump. If the level drops sufficiently to open the valve (18), fresh water from the mains supply (19) passes into the sump under pressure. When the level has risen sufficiently, the float valve (24) switches off the supply. Fixer replenishment is accomplished by taking wash solution either from the sump (17) (as shown) or by withdrawing it directly from the wash tank (not shown) and pumping it into fixer tank (22) by means of pump (12). At the same time as (12) is operating, pump (11) withdraws fixer concentrate from the holding vessel (6) and supplies it to fixer tank (22) in a predetermined ratio compared with that supplied by (12). Extra level sensors (not shown) may also be provided so that evaporation losses may be controlled and appropriate extra solution replenishment may be made in any of the tanks.

Figure 4:
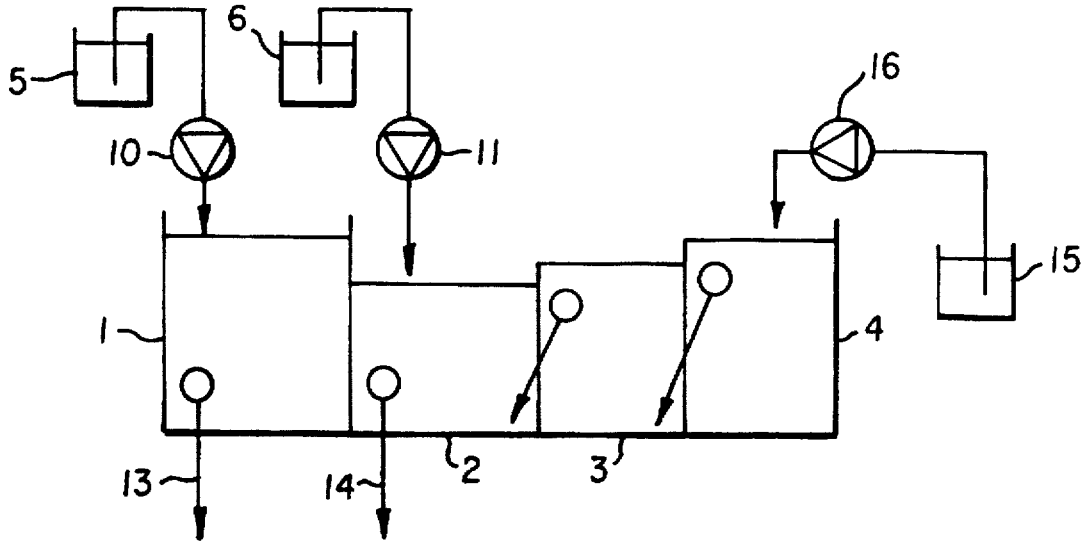

FIG. 4 shows another embodiment of the present invention. The processor is provided with single developer (1), fixer (2) and two wash tanks (3 & 4). Wash water pump (16) and fixer concentrate pump (11) are operated simultaneously to deliver solutions from tanks (15) and (6) respectively in a predetermined ratio of volumes. The action of pump (16) replenishing the wash tank (4) causes the overflow to cascade into the fixer tank (2). Extra level sensors (not shown) may also be provided so that evaporation losses may be controlled and appropriate extra solution replenishment may be made in any of the tanks.

Figure 5:
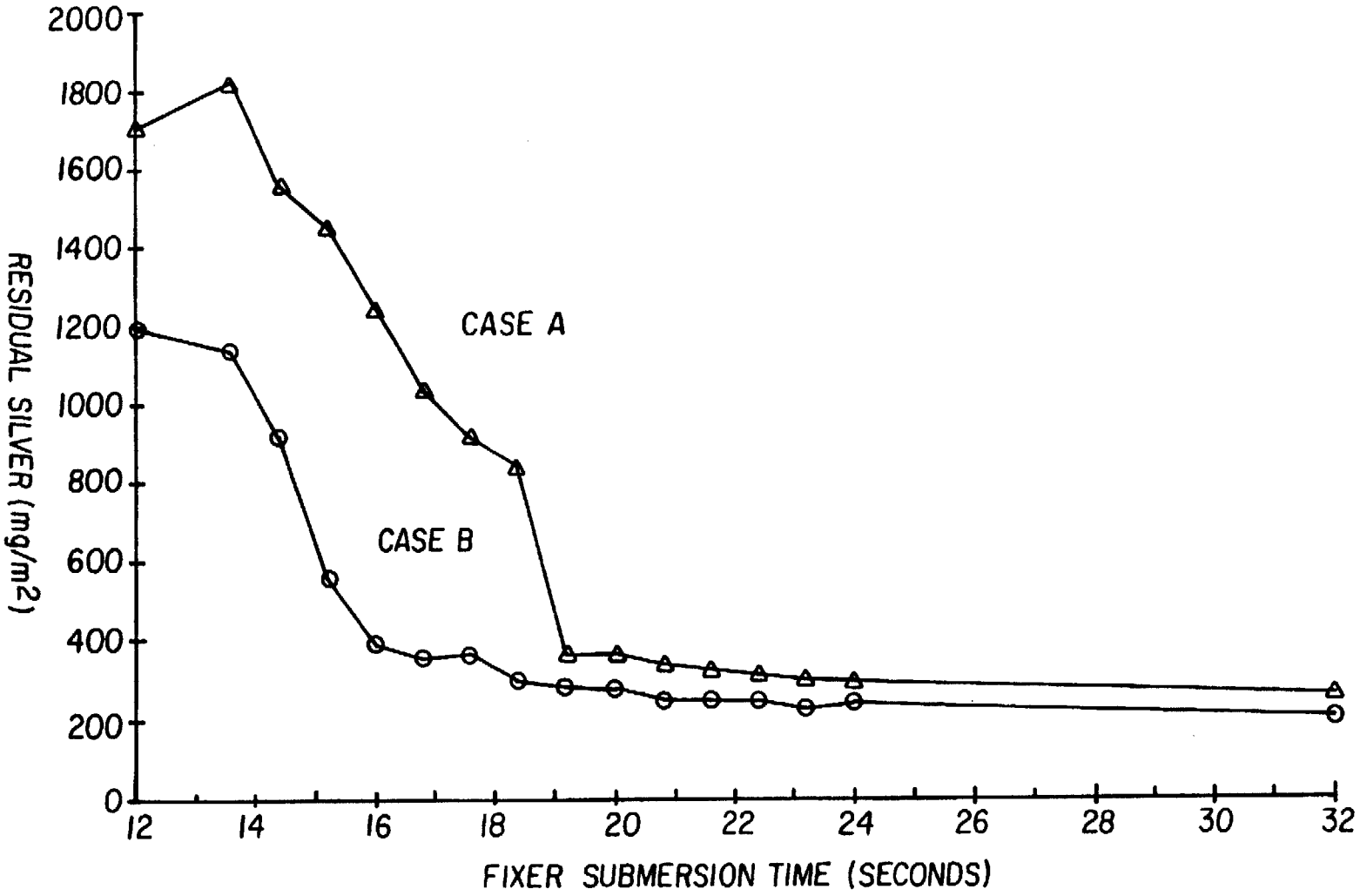
FIG. 5 is a graph showing the results of the Example below.

FIG. 5 is a graph showing the silver carried out of the fixing solution by the photographic material as a function of submersion time in the fixer solution. The data plotted resulted from the following example which is included for a better understanding of the invention.

Black-and-white photographic materials, in particular graphic arts high contrast materials and radiographic materials, are well known. They may have silver coating weights in the range 1 to 15 g/m$^2$, typically 2 to 8 g/m$^2$, and most typically 2.5 to 6 g/m$^2$.

The following Example is included for a better understanding of the invention.

EXAMPLE

An experiment was performed to show the advantages of the present invention. As a control (case A), a conventional processor as shown in FIG. 1 with a developer tank, fixer tank and two wash tanks was used to process graphic arts film. Wash water overflow was collected for treatment and was not used to dilute fixer concentrate. No silver recovery system was used to remove silver from the fixer. The coated silver weight of the film was 3.3 g/m$^2$ and the halide ratio was 70% chloride to 30% bromide. Exposure was about 2% by area (in order to produce a very high level of silver in the fixer since 98% of the coated silver would not result in a developed image and would therefore need to be fixed), wash replenishment rate was 125 ml/m$^2$, and fixer replenishment rate was also 125 ml/m$^2$. The fixer replenisher was made from a concentrate (formula A as shown in Table 1 below) diluted at 2 parts by volume water to 1 part by volume concentrate. Development and fixing times were both 25 seconds at 35° C. and the wash time was 30 seconds in total at 20° C. A fixing time of 25 seconds corresponded to a fixer submersion time of 20 seconds in the processor used for the experiment since the ratio of air time to submersion time was 1:4. Several hundred square meters of film were processed to ensure that the fix and wash baths were fully seasoned.

Several small unexposed pieces of the same film were then processed at various processing times from 15 seconds to 40 seconds, the development and fixing times being equal in each case. (The processing times include the time taken to travel through the air between processing tanks. So, for example, the development time is defined as the time taken from when the front edge of a piece of film just touches the developer solution in the developer tank to when it just touches the solution in the fixing tank. This range of processing times corresponds to a range of fixer submersion times from 12 seconds to 32 seconds). The wet film samples were not washed, being removed from the processor after they had passed out of the last roller pair nip at the exit of the fixer bath. The samples were allowed to dry in the air after which the amount of silver in mg/m$^2$ remaining in each sample was measured by X ray fluorescence.

TABLE 1

Formulae for approximately 1 liter of concentrate

| Component | Formula A (g) | Formula B (g) |
|---|---|---|
| Acetic Acid | 48 | 30 |
| Ammonium Acetate | 90.9 | 68 |
| Ammonium Thiosulphate | 535 | 500 |
| Ammonium Sulphite | 48 | 40 |
| Water - demineralized | 521 | 606 |

The processor was then converted to be able to implement the present invention in the form shown in FIG. 2 (case B). Processing and exposure conditions were unchanged, except that a re-balanced fixer concentrate (formula B as shown in Table 1 above) was used directly to replenish the fixer tank at a replenishment rate of 62 ml/m$^2$. The wash replenishment rate remained at 125 ml/m$^2$. Once the solutions were fully seasoned after processing a further several hundred square meters of the same film as before, the test of silver remaining in the film versus fixer submersion time was performed once again. The results of both sets of tests are shown in FIG. 5 which is a plot of residual silver versus fixer submersion time.

As fixer submersion time increases from 12 seconds, the residual silver in the film drops rapidly. In the case of conventional replenishment (case A) the majority of the "washing-out" part of the fixing process is not complete until around 19 seconds. In the case where wash water from the wash tank is used (case B), this point happens 3 to 4 seconds earlier. At 20 seconds, there is approximately 24% less silver in the film processed in case B than in case A. At 16 seconds, however, there is approximately 69% less silver for case B. Thus at shorter fixing times, the present invention (case B) gives a very significantly greater benefit than might be expected from a simple consideration of the fixer silver concentrations in the two cases: at the end of the case A experiment, the fixer silver level was 21 g/l, whereas at the end of the case B experiment, the fixer silver level was 18.5 g/l. Thus, the fixer silver level for case B was 88% of that for case A.

The reason why the technique yields a greater benefit than expected is that with case B, the film has longer to equilibrate with the fixer solution once the majority of the "washing out" part of fixing is complete, i.e. around 4 seconds. For case A, there is only about 1 second. Therefore, more silver is removed from the film in case B. The extra time for equilibration arises from the fact that fixing proceeds quicker in case B since fixing rate is inversely dependent on fixer silver concentration and in case B, the fixer silver concentration is lower than for case A. It is the extra dilution effect which causes the fixer silver level to drop in case B. Without the extra dilution arising from a larger flow of solution through the fixer in case B, the fixer silver level would rise in comparison with case A on account of the presence of silver in the wash solution used to dilute the fixer concentrate.

Since less silver is carried into the wash section in case B, there is less load to be washed out of the film. At the end of the case A experiment, the amount of silver remaining in the film after the full process: i.e. development, fixing, washing and drying was 11 mg/m$^2$, whereas at the end of the case B experiment, the silver remaining was 8 mg/m$^2$.

Considering the effect of the present invention on fixing time, in case A, 80% of the silver has been removed in around 19 seconds. Using the proposed definition of a short fixing time, 19 seconds is around 80% of 24 seconds. In the example, the fixer submersion time was 20 seconds and would therefore be an example of a process with a "short" fixing time since it is less than 24 seconds.

In summary, the above shows that by applying the present invention,

1) Fixing rate has been increased
2) The volume of fixer replenisher used per unit area of film processed has been reduced, and
3) Washing performance has been improved.

It will be apparent that the improvement in washing performance may be traded for a reduction in washing time or a reduction in the wash replenishment rate or both. It is noted, however, that the wash replenishment rate should not be so low that sufficient dilution of the fixing agent in the washing bath is not achieved and residual fixing agent in the processed material becomes the key determinant of image stability upon ageing.

It will also be apparent that fixing rate may be increased by raising the temperature of the fixing bath. This is not generally desirable since evaporation from the fixer bath is thereby increased and problems of crystallisation of fixer on rollers and creep of fixing agent over tank walls to adjacent tanks is increased. Furthermore, energy required to heat the solutions is increased and warm-up time is also increased. Most graphic arts processors are run at fixing temperatures of 35° C. which is sufficient to be above ambient temperature in most parts of the world. It is known for radiographic processors to use fixer temperatures of 38° C.

In the present process fixing times should be short with respect to the maximum expected silver concentrations to see the greatest benefit. Fixer submersion times under consideration are less than 30 seconds. Greater benefit would be seen with submersion times less than 25 seconds and greatest benefit would be obtained with submersion times below 20 seconds. Maximum expected silver concentrations under consideration are preferably greater than 10 g/l and most preferably greater than 15 grams/liter.

PARTS LIST

1 . . . developer tank
2 . . . fixer tank
3,4 . . . wash tanks
5 . . . holding tank
7 . . . sensor control means
9 . . . level sensor
10 . . . pump
11 . . . pump
12 . . . pump
13 . . . developer overflow
14 . . . fixer overflow
15 . . . holding tank
16 . . . pump
17 . . . sump
18 . . . valve
19 . . . mains supply
20 . . . pipe
21,22 . . . fixer tanks
23 . . . wash tank
24 . . . float valve
26 . . . holding vessel
25 . . . overflow

We claim:

1. A method of processing silver halide black-and-white photographic material in a processing machine which transports the material to be processed, through several processing tanks including, at least one tank with fixing ability and at least one tank which is either a wash or stabilizer tank characterised in that:

i) the wash or stabilizer tank furthest from the fixer tank(s) is replenished with wash or stabilizer solution, ii) outflow from the wash tank or stabilizer tank nearest the fixer tank(s) is passed to the nearest fixer tank together with a fixer replenishment solution to maintain the fixer's working composition, iii) the total submersion time in the tank(s) having fixing ability is less than 25 seconds, and iv) the concentration of silver in at least one of the tanks with fixing ability is greater than 10 g/l.

2. A method according to claim 1 in which silver compounds are not extracted from the processing liquid in the fixer tank(s) in any way other than by overflow or carryout in the photographic materials being processed.

3. A method according to claim 1 in which the total submersion time in the tank(s) having fixing ability is less than 20 seconds.

4. A method according to claim 1 in which the rate of addition of fixer replenisher solution is below 125 ml/m$^2$ of material processed.

5. A method according to claim 4 in which the rate of addition of fixer replenisher solution is below 75 ml/m$^2$ of material processed.

6. A method according to claim 1 in which the rate of addition of wash or stabilizer outflow to the fixer tank is below 250 ml/m$^2$ of material processed.

7. A method according to claim 1 in which the rate of addition of wash or stabilizer outflow to the fixer tank is below 125 ml/m$^2$ of material processed.

8. A method according to claim 1 in which the concentration of silver in at least one of the tanks with fixing ability is greater than 15 g/l.

9. A method according to claim 1 in which the photographic material is a silver halide high contrast graphic arts film or paper.

10. A method according to claim 1 in which the entire outflow from the wash or stabilizer tank nearest the fixer tank(s) is passed to the nearest fixer tank.

* * * * *